US005909750A

United States Patent [19]

Sanders

[11] Patent Number: 5,909,750

[45] Date of Patent: Jun. 8, 1999

[54] MULTIPLE STAGE DEVICE AND METHOD FOR MANUFACTURING A WOVEN FABRIC

[76] Inventor: Falk-Hayo Sanders, Aussichtsstr. 6, CH-8704 Herrliberg, Switzerland

[21] Appl. No.: 08/888,564

[22] Filed: Jul. 7, 1997

[30] Foreign Application Priority Data

Jun. 12, 1997 [DE] Germany ..... 197 24 893

[51] Int. Cl.[6] ..... D03D 41/00; D03J 1/02

[52] U.S. Cl. ..... 139/11; 139/34; 8/115.6; 28/151

[58] Field of Search ..... 139/34, 18, 11, 139/33, 28; 8/115.6; 28/151

[56] References Cited

U.S. PATENT DOCUMENTS

| | | | |
|---|---|---|---|
| 1,508,942 | 9/1924 | Shook | 139/33 |
| 2,077,532 | 4/1937 | Rossiter | 139/34 |
| 2,802,255 | 8/1957 | Wallach | 28/151 |
| 3,403,704 | 10/1968 | Rebek | 28/151 |
| 3,523,432 | 8/1970 | Vajda et al. . | |
| 4,162,562 | 7/1979 | Beauregard | 139/34 |
| 4,741,366 | 5/1988 | Yamotogi | 139/34 |

FOREIGN PATENT DOCUMENTS

| | | | |
|---|---|---|---|
| 0 391 612 A1 | 10/1990 | European Pat. Off. . | |
| 0 460 129 B1 | 12/1991 | European Pat. Off. . | |
| PS 685 892 | 12/1939 | Germany . | |
| OS 2 021 676 | 5/1970 | Germany . | |
| 26 25 746 B1 | 12/1977 | Germany . | |
| 38 21 224 C1 | 1/1990 | Germany . | |
| 404343737 | 11/1992 | Japan | 139/34 |
| 93/06282 | 4/1993 | WIPO . | |

OTHER PUBLICATIONS

German Search Report for DE 197 24 893.4, May 19, 1998.

*Primary Examiner*—Andy Falik
*Attorney, Agent, or Firm*—Frohwitter

[57] ABSTRACT

A method for manufacturing a woven fabric having a limited length comprising the following steps: laying a layer of warp threads on a warp frame having a size which is determinative of the limited length of the fabric and holding said warp threads, on said warp frame, moving said warp frame to a weft insertion mechanism having a shed forming device, laying weft threads into said warp threads while operating said shed forming device, transporting said warp frame having a completed fabric thereon to a fabric removal station removing said completed fabric from said warp frame.

12 Claims, 7 Drawing Sheets

2
3
4
12
15
16
17
18
22
23
24
25
26
27
28
29
30

MULTIPLE STAGE DEVICE AND METHOD FOR MANUFACTURING A WOVEN FABRIC

The invention relates to a method for the manufacture of woven fabric in limited lengths and a device for this method.

BACKGROUND OF THE INVENTION

The manufacture of woven fabric is today done on weaving machines, which pull their warp threads from a warp beam, that is normally prepared for warp-lengths or lot sizes of more than 1000 yards. The warp-beam is a major element for the manufacture of woven fabric. For its own manufacture there is a time consuming and costly process that is relatively independent from the warp length. Therefore only long warp lengths, as indicated before, are economically feasable in the manufacture of woven fabric. For the manufacture of standard fabric, for example for a normal white shirt fabric, it does not matter that the fabric has to be produced in so large lot sizes, because this kind of fabric is always used as a standard fabric. But for the fast moving fashion cycles which often require a huge variety of patterns, the manufacture of a normal warp beam is a handicap, because it is very difficult to forecast how much of a specific fabric will be sold later on.

Therefore it is a requirement today to find an economical process that enables the manufacture of woven fabric in relatively short lengths (small lot sizes), for example in lengths of a few hundred yards and below. A warp beam for such a short length requires so much work, that the woven fabric becomes much more expensive per yard, often so much more, that the manufacture of this fabric is economically not justifiable anymore.

SUMMARY OF THE INVENTION

The purpose of this invention is, to create a method for the manufacture of woven fabric in short lengths, for which the manufacture of a special warp beam is not economical or takes too much time.

According to one aspect of the invention there is provided a method with the following steps:

- laying a layer of warp threads on a warp frame having a size which is determinative of the limited length of the fabric and holding said warp threads on said warp frame,
- moving said warp frame to a weft insertion mechanism having a shed forming device,
- laying weft threads into said warp threads while operating said shed forming device,
- transporting said warp frame having a completed fabric thereon to a fabric removal station, removing said completed fabric from said warp frame.

For the method according to this invention no warp beam is needed. For laying of the warp threads in the warp thread station a warp frame is used, over which length the warp threads are layed and held onto the warp frame.

For the laying of the warp threads over the warp frame the known technologies for drawing-in (EPPS 460129B1, EP 0391612) and/or for weft-insertion (DEPS 3821224) can be used, i.e. in the first process-step a parallel laying of threads is done in a way like weft-threads are layed, these threads are then used as the warp threads for the subsequent manufacture of the woven fabric. Also for holding of the threads at the warp frame known technologies can be used, for example the known clamping of warp-threads in drawing-in-machines (WO 93/06282, DEAS 2625746, U.S. Pat. No. 3,523,432).

This so manufactured semi finished product in form of a layer of next to each other laying warp threads within the warp frame is then completed, by bringing in of the warp frame by means of the first transfer step into the weft thread insertion mechanism. Here, within the weft thread station the shed formation is done with a known shed forming-device (e.g. shed forming comb elements with guide bars, heddle shafts with heddles, Jaquard heddles.) If weaving heddles or Jaquard heddles are used, they are already interspersed with the warp threads in the warp thread station. The warp-frame is thereby, with the warp threads that are held by it, prepared for the shed formation and the laying of the weft threads, which are then layed in a known fashion and the beaten up to the fabric fell. Thereby, the fabric is manufactured within the warp frame up to the length and width that is determined by the warp frame. The beating up of the weft thread onto the fabric-fell can be done with a closed reed, which would also be already interspersed with the warp-threads in the warp-thread-station, as well as with an open reed (reed-comb). In this way a piece of woven fabric is manufactured without the need of a warp beam.

Woven fabric for apparel and other end uses can thus be manufactured very quickly in the required sizes and patterns, because the warp frames can be big enough to allow the manufacture of large enough pieces of fabric. The finished fabric can be taken out of the warp-frame and can directly be used for the manufacture of pieces of apparel. It is also possible to do the necessary cutting of the fabric already within the warp frame. After taking out the fabric or the remaining fabric-pieces after cutting, the warp frame is reused for laying of warp threads in the warp thread station.

The fabric in the warp-frame can also be run in its semi-finished state through further processes like they are used for the manufacture of woven fabric today, like sizing of the warp threads before the weft-insertion or finishing processes of the completed fabric.

A major advantage of the invented method is the fact, that small lot-sizes (relatively short fabric-lengths) can be manufactured economically, which is not possible by using a warp-beam. The manufacture of a warp beam consists of preparation-costs that are relatively independent of the warp-lengths, and thereby grow in importance the shorter the woven fabric is. The required long fabric lengths of today also lead to extensive ware housing which in turn lead to a very long total throughput time from the start of the process up to the end product in form of a finished piece of apparel. This total through-put time can be drastically reduced by the invented manufacturing method, because relatively short fabric lengths can be manufactured according to a certain customer demand.

The invented manufacturing-method facilitates thereby in a decisive way the economical manufacture of woven fabric and the resulting fabric-samples that have to follow the fast moving changes in fashion. This is achieved, because on the one hand as described above the relatively short fabric lengths enable a quick reaction to individual customer demands and on the other hand make a quick reordering of a fabric possible which is required, if a fabric or the resulting piece of apparel sells better than expected. This quick reaction until today was impossible in an economical way, although it is already a requirement of retailing for a long time. The invented manufacturing method will lead to an enormous increase in speed and flexibility for the entire textile chain and can lead to bringing back a lot of textile jobs into high labour cost countries.

It is possible that the wrap-frame holds the layer of threads taut or slack. Especially during the transfer steps the warp threads may be held slack, what could possibly lead to a space saving. In addition the slack holding may be helpful during sizing or the finishing-processes. Nevertheless the layer of warp threads has to be held at least partially taut where the weft threads are layed.

Especially in the warp thread-station the laying of the warp threads can be done essentially in a vertical direction, hereby gravity can be used to help guiding and straightening the warp-threads. This may also lead to a space saving compared to the horizontal positioning. But it is also possible to use the horizontal positioning for the whole method.

It is also possible to link up the warp threads of two warp frames by using a conventional knotting machine. This could help to eliminate the need to intersperse the needles and the reed in the warp thread station. The shaft of the warp frame would then be removed after knotting and before tuning through the weft thread station.

The device for the above described method consists mainly of the mentioned warp frame, that can be carried out in several different ways. At first it is necessary to provide at least two strips, shafts or rails with thread-holding-devices to face each other, that are holding the layer of warp-threads. In this case this strips, shafts or rails have to be held at the required distance from each other through special means, while the thread holding devices ensure that the threads can not slip off.

If a fixed frame should be used for carrying out this manufacturing method then the two facing strips, shafts or rails are connected by two bridges that are holding the strips, shafts or rails at a fixed distance to each other. The result is a fixed object, that is advantageous especially for short frame lengths.

It is also possible, to arrange the strips, shafts or rails in such a way, that they are moveable between the distance that is defined by the length of the held warp threads and a shorter distance. This is helpful, when for example the layer of warp threads is at first layed taut over the warp frame and after that the next transport is done, in a slack way. In the latter case the layer of warp threads would then hang below the strips, shafts or rails. Hereby it is also possible to form at least one of the strips, shafts or rails as a rotatable cylinder. This can help to save space, for example in the weft thread station. If only one cylinder is rotatable, it is possible to use a conventional practice thread carriage like it is used in warp knitting that runs across the warp frame from one side to the other, in which case through unwinding or onwinding of the previously layed warp-threads one shot after the other is layed continuously in such a way, that the fabric is formed. Hereby it is of course necessary, that one of the cylinders either the rotatable or the non rotatable moves towards the other or away from it, i.e. it has to be linked to a transfer mechanism. It is also possible, that both shafts or cylinders are rotatable, which would give the same effect regarding the space-saving, but without needing, to move one of the cylinders relative to the other. Hereby it has to be taken into account, that such an arrangement could be easier to retrofitt into existing weaving machines with their drive mechanisms for the warp beam.

BRIEF DESCRIPTION OF THE DRAWINGS

The invention is explained in more detail below by means of exemplary embodiments and the drawings.

They show.

DETAILED DESCRIPTION OF THE INVENTION

Figure 1:
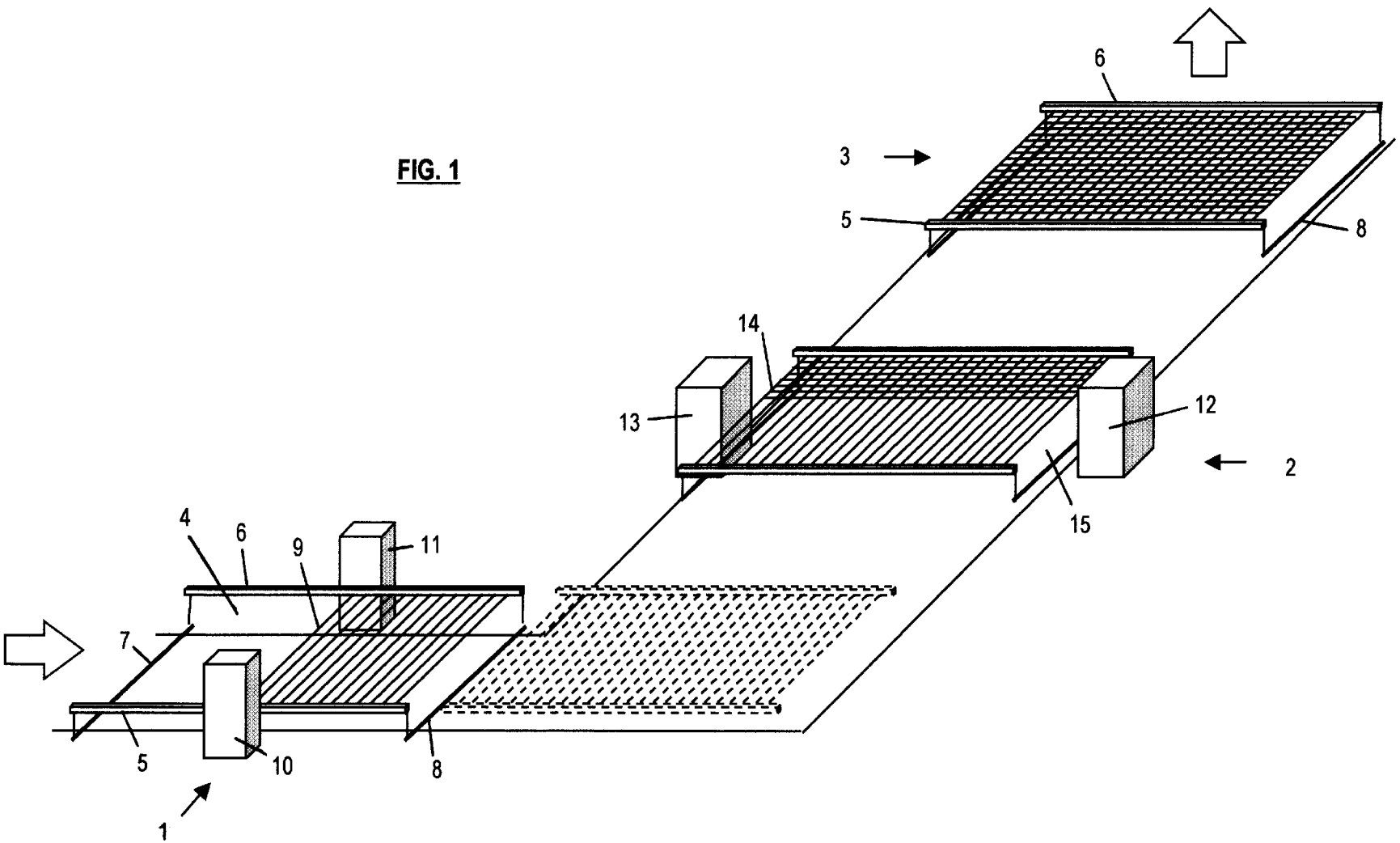
FIG. 1 a mechanism in principle perspective view, that works according to the method, FIG. 2 a plant according to FIG. 1, equipped with heddle shafts and heddles.
Figure 6:
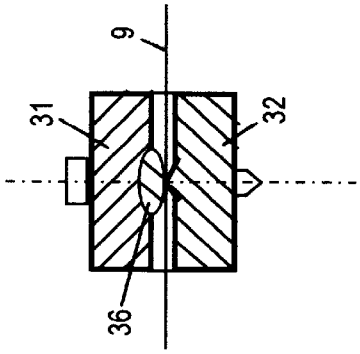
Figure 5:
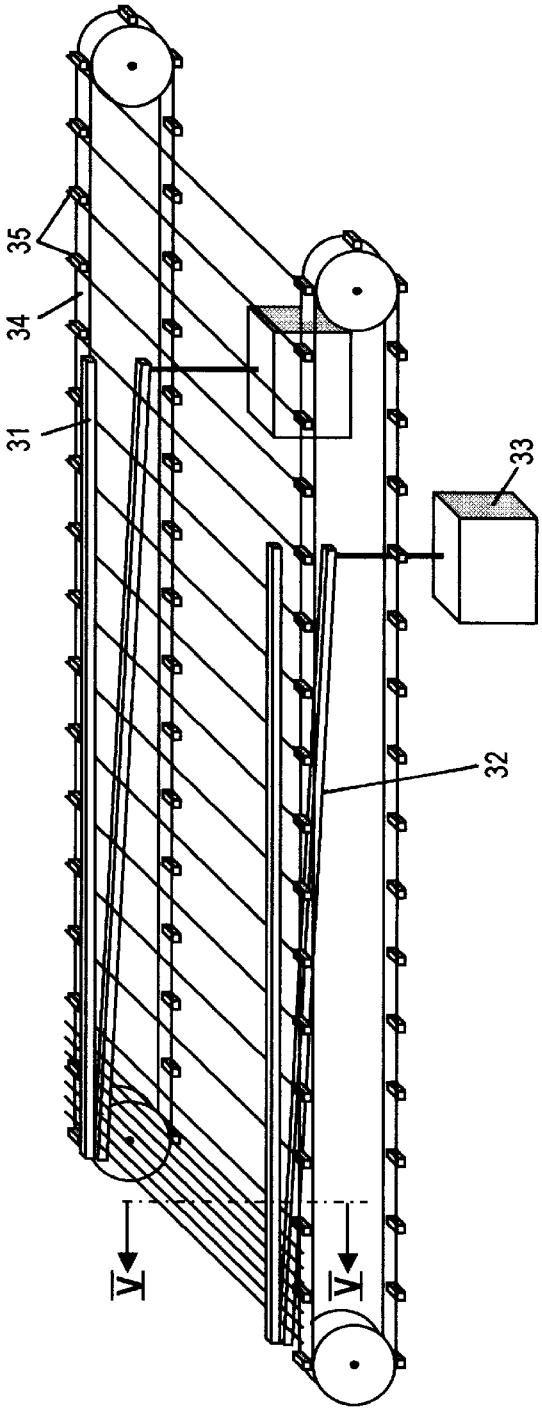
FIG. 5 is a perspective view of an arrangement for clamping of the warp threads, FIG. 6 a sectional view along the line V—V from FIG. 5.

In FIG. 1 a plant according to the invented method is shown, that contains the warp thread station 1, the weft thread-station 2 and the take-out-station 3. In each of these stations a warp-frame 4 is shown, that consists of the two shafts 5 and 6 and of the connecting bridges 7 and 8. Within the warp thread station 1 warp-threads 9 are layed over the warp-frame 4, by operating the insertion mechanisms 10 and 11 that work like normal weft insertion- and/or drawing-in mechanisms, which in this case lay threads, that are used as warp-threads for the final fabric later on. Hereby the warp-threads are held in the area of the shafts 5 and 6 for example by holding-devices like they are shown in FIGS. 5 and 6. Through moving of the warp-frame 4 relative to the insertion-mechanisms 10 and 11, a layer of warp-threads is layed continuously over the whole warp frame until the frame is full. Hereby it is of course necessary to move the warp frame 4 to the right, where enough room has to be provided for this movement. Finally the warp frame is moved into the position that is indicated by dotted lines.

The warp frame 15 now holding a layer of warp threads, in FIG. 1 shown in dotted lines with dotted warp threads and is then transfered by the first transfer step into the weft thread station 2. Hereby conventional weft-thread-insertion-mechanisms 12, 13 with common devices for the shed formation and the beat-up onto the fabric fell are used, which now lay the weft threads 14 across the previously layed warp-threads 9, whereby the woven fabric is created. In this station the here located warp frame 15 is moved along the weft-thread-insertion-mechanisms 12 and 13, so that finally the whole warp-frame 15 is filled up with completed fabric. The warp frame 15 is of course the same "warp-frame" like it is marked with reference 4 within the warp thread station.

After complete laying of the weft threads 14 in the weft thread station, the moving out of the warp-frame is done by means of the second transfer step into the take out station 3, where the fully produced fabric can be removed from the warp frame. The production process for the desired woven fabric is now in principle complete.

For the transport of warp frame 4 respectively the warp frame 15 conventional transport-belts used, whose detailed design does not matter within the context of this invention, i.e. conventional transport systems are employed.

Figure 2:
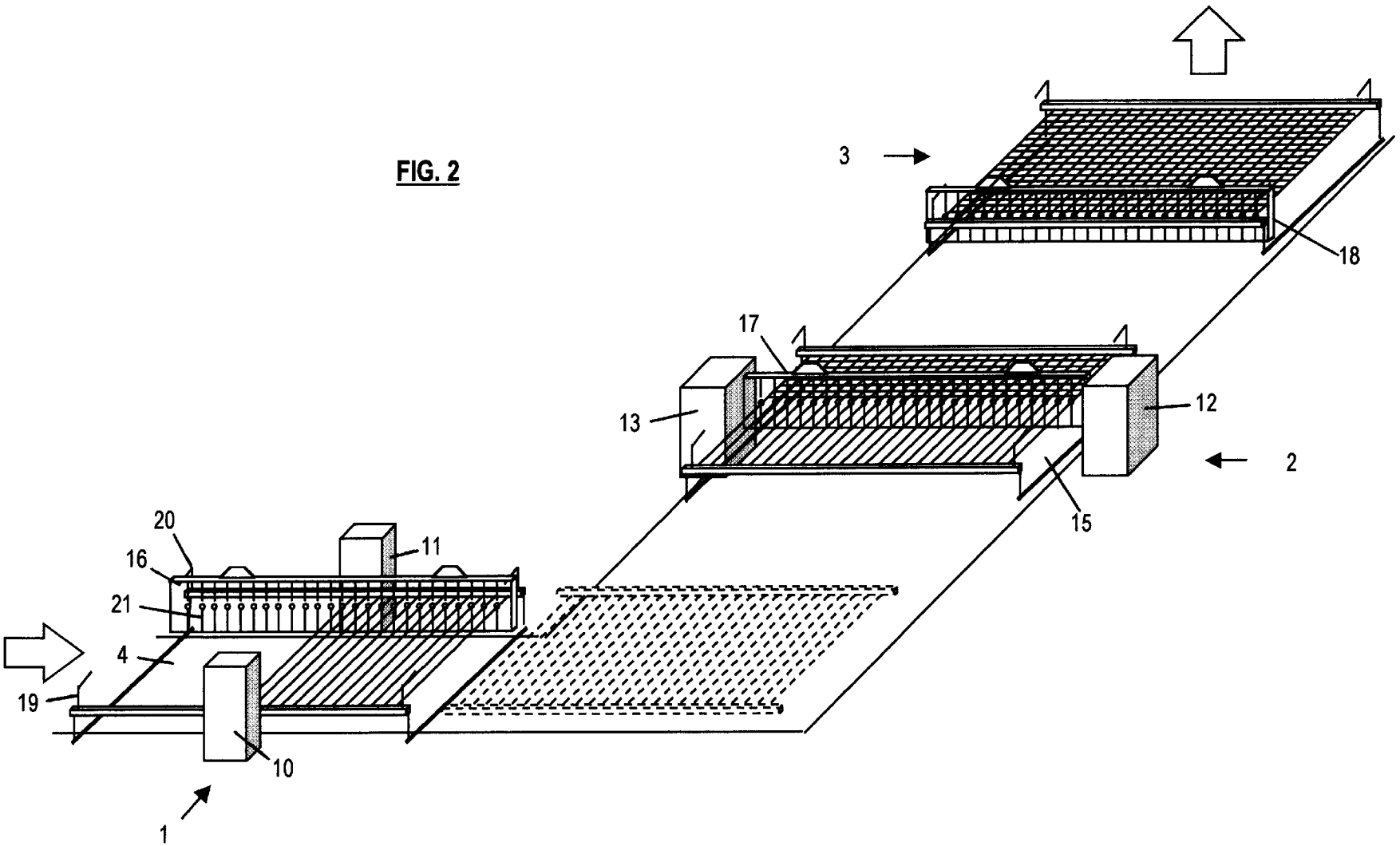

FIG. 2 a plant is shown that is almost identical to the plant shown in FIG. 1, where only the heddle shafts 16, 17 and 18 that are normally used for the weft insertion are drawn in. The other shown moduls in FIG. 2 are the same as in FIG. 1 and are therefore marked with the same references. The heddle shafts 16, 17 and 18 are held by carriers, that are marked in the area of the warp thread station with the references 19 and 20. They are provided on both sides of the warp-frame. Before the start of the production process, the frame 4 is fitted with the heddle shafts 16, that are then running through all stations, and at the end of the take out station 3 are also taken out, to be refitted into another warp frame in the warp thread station. In the heddle shafts 16, 17 and 18 in the heddleshafts used wires 21 are shown. Regarding the functioning of the plant in FIG. 2 it is referred to the descriptions for FIG. 1.

Figures 3A, 3B, 3C:
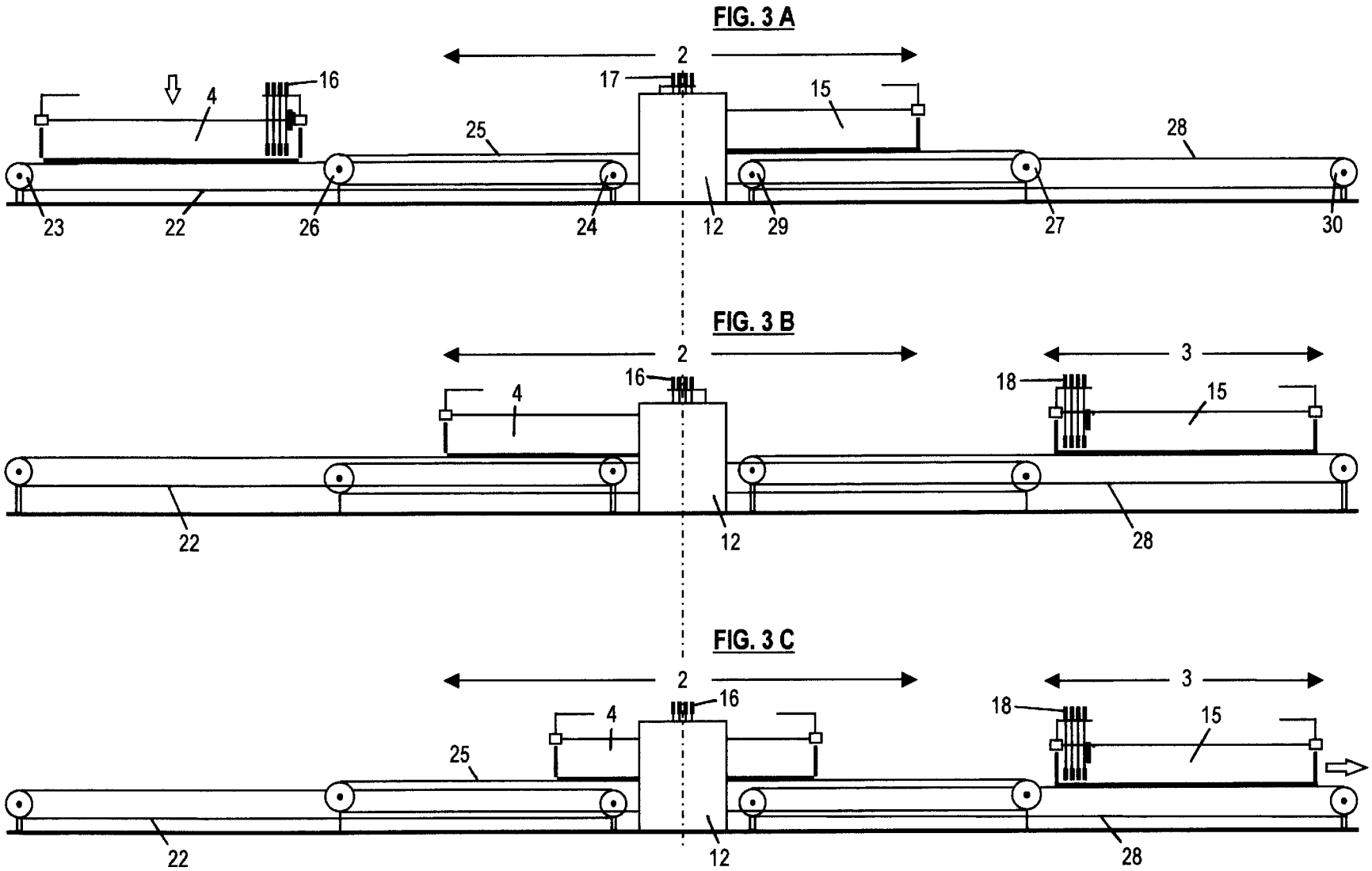
FIGS. 3A–3C are side views illustrating a warp thread station, a weft thread station and a take-out-station.

In FIGS. 3A–3C the sequence of the method is shown in three diagrams A, B and C, that are drawn superimposed over each other, which show in a way the arrangement of FIGS. 1 and 2 in side elevation, whereby stations 2 and 3 are visible (station 1 is hidden by the warp-frame 4 shown in FIG. 3A, that in this figure is in a holding-position in front of station 2. Its holding-position is indicated in FIGS. 1 and 2 by the dotted lines).

FIG. 3A shows the warp-frame 4 with the heddle shafts 16 in the above mentioned holding-position, while warp frame 15 is in the area of the weft thread insertion mechanism 12, i.e. in the weft thread station 2. The frame 15 has already arrived at the end of the weft thread insertion process, by way of transport belts, which will be described further below. At first the warp frame 15 is moved into the take out station 3 and then the warp-frame 4 is moved into the station 2, which is shown in FIG. 3B. In this weft thread station 2, the warp frame marked with the reference 4 is filled with the weft threads, which are inserted across the warp threads. For this purpose the heddle shafts 16, are now connected to the weft thread insertion-mechanisms 12 and 13 (13 is not visible in FIG. 3B), so the weft threads can be woven in a conventional manner as already described above. After this the previous warp-frame 15 moves further to the right, which can be seen in FIG. 3C. In FIG. 3B the previous totally fabric filled warp frame 15 can also be seen in the take-out station 3, where the finished fabric can be removed out from the warp frame, whereupon the warp frame is transfered back to the warpthread station that is shown in FIGS. 1 and 2. This happens, while a warp frame is within the weft thread insertion mechanisms 12 and 13, as like it is shown in FIG. 3C, i.e. during the operating phase according to FIG. 3C, the warp-frame that is shown on the right side is taken away from the transport system and transferred to warp thread-station shown in FIGS. 1 and 2, if it is not planned for further processes within the warp-fame like finishing processes or cutting.

For the transport of the warp-frames 4 and 15 in the FIGS. 3A–3C controlled transport belts are planned, which move the warp-frames, where certain transport belts can be moved into and out of action by lifting them up or lowering them down. According to FIG. 3A the warp frame 4 is moved by transport belt 22 with the belt rollers 23 and 24, but the movement only starts if the previous warp frame is already moved out of the weft thread station 2. The warp frame 15 within the weft thread station 2 is moved by transport belt 25 with the belt-rollers 26 and 27, because transport belt 25 is in a higher position than transport belt 22. The warp-frame 15 is there also above the third transport belt 28 with the belt rollers 29 and 30, which takes over the warp-frame 15 after it has completely run through the weft thread, station 2, by lifting-up (see FIG. 3B) into a position so that transport belt 28 is above transport belt 25. With the transport belt 28 the warp-frame 15 is moved into the end-position, that is shown in FIG. 3B within the take-out station 3. While this is happening, a new warp frame 4 is moved into the weft thread station, as already explained. For this, the transport belt 22 was lifted up, lifting the warp frame 4 as it is shown in FIG. 3A, which is then out of reach for transport belt 25. After moving in of the warp frame 4 into the area of the weft thread insertion mechanism 12, the transport belt 22 is lowered down, so that the transport belt 25 now overlaps the warp frame 4, as it is shown in FIG. 3C.

The warp-frame that is in the weft thread station 2, is then exposed to the operation of the weft thread insertion mechanism 12, that now weaves the weft threads into the warp threads, that are held by the warp frame, until the warp-frame gets to the position that is marked with reference 15 in FIG. 3A. While the weft threads are layed within the weft thread station 2, the finished fabric is taken out of the warp frame that is in the take-out-station 3, and this frame is then transfered back to the warp-thread-station as already explained above (see FIGS. 1 and 2).

Figure 4:
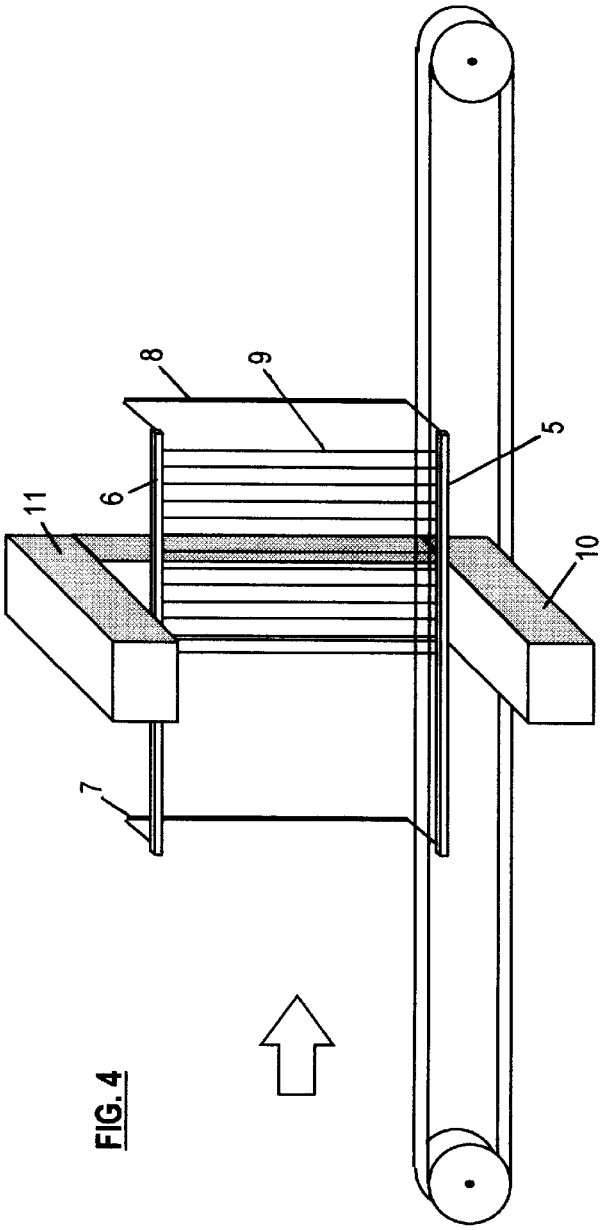
FIG. 4 is a perspective view of a warp thread station in a vertical position.

FIG. 4 shows another version of the warp thread station according to FIGS. 1 and 2, where the warp-threads 9 are layed in a vertical direction by the insertion-mechanisms 10 and 11. This can be mandated when the floorspace is limited, and in addition this may lead to an energy saving. In the fist transfer-step a transfer into the holding-position that is shown in dotted lines in FIGS. 1 and 2 is then necessary for which a conventional transfer mechanism can be used, of which the design is not relevant here.

FIG. 5 shows an example for the execution of an arrangement for clamping of the warp threads, which, as indicated above, comes into effect during the laying of the warp threads in the warp thread station 1 (see description to FIG. 1). The clamping arrangement uses the shafts 5 and 6 according to FIG. 1 in the form of the halfround shafts 31 and 32, where halfround shaft 31 is held stationary, while halfround 32 is pressed continuously further against half-round shaft 31 by the lifting-device 33, depending on the progress of laying the warp threads. The warp threads are layed by the insertion-mechanisms 10 and 11 from FIG. 1 over an additional device, in form of chain 34 with individual holders that are each equipped with a single clamp on either side, are then clamped and cut (DE-AS 26 25 746) so each holder is then holding one warp-thread, which is now moved into the area of the halfround shafts 31 and 32, where the clamps on the holders 35 are opened in a controlled movement, so the warp threads are layed next to each other with the required distance, are preclamped by the half round shafts 31 and 32 and are finally fully clamped by bringing both half round shafts completely together.

FIG. 6 shows a sectional view along the line V—V from FIG. 5. It shows the two half round shafts 31 and 32, of which halfround shaft 31 is equipped with an elastic strand 36, which presses onto an inserted thread, preclamps it at first and finally fully clamps it by bringing both half round shafts completely together.

Figure 7:
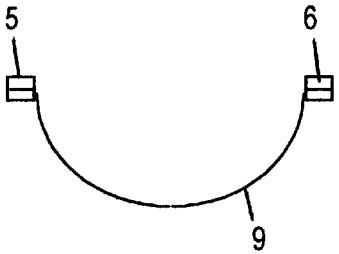
FIG. 7 is a side view of a layer of warp-threads held slack.
Figure 8:
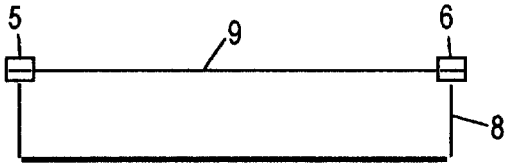
FIG. 8 is a side view of a layer of warp-threads held taut.
Figure 9:
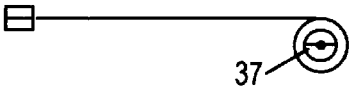
FIG. 9 is a side view of a warp frame consisting of two shafts, where one shaft is rotatable as a turnable cylinder.
Figure 10:
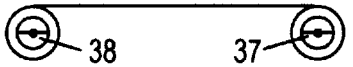
FIG. 10 is a side view of a warp frame similar to FIG. 9, where both shafts are formed as rotatable cylinders.
Figure 11:
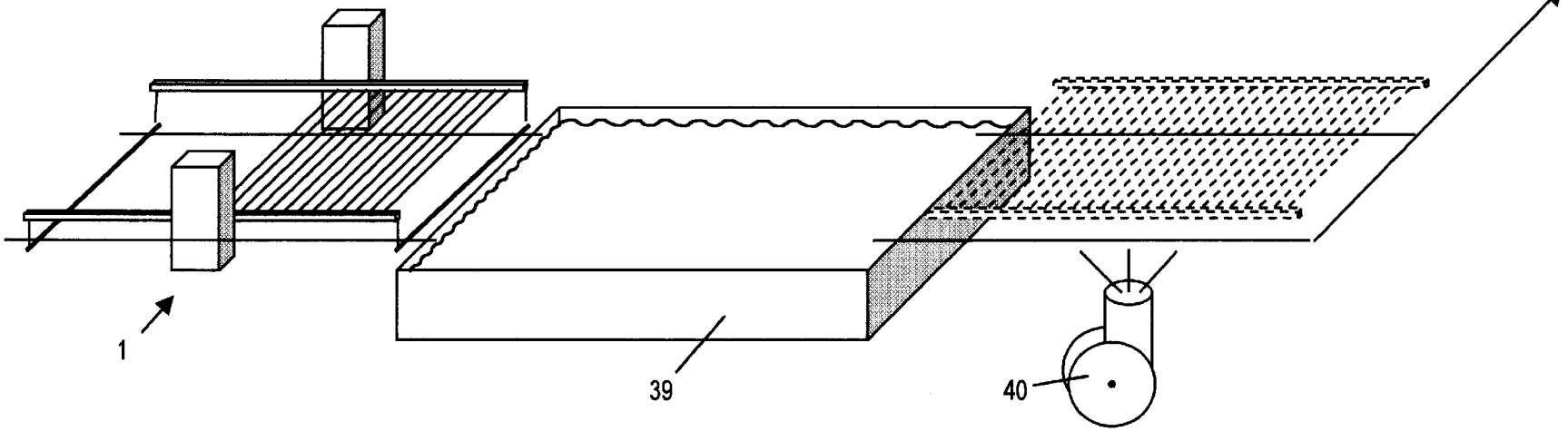
FIG. 11 is a perspective of the addition of the process step of sizing, FIG. 12 the process step of finishing.

FIG. 7 shows a warp in a slack manner, held by two shafts 5 and 6, hanging loosly between them. If the two shafts 5 and 6 are moved away from each other, the position shown in FIG. 8 results, where the warp-thread 9 is shown taut. The tautness is kept by the bridge 8. In FIGS. 9 and 10 two variants of the shafts which are belonging to the warp-frame are shown, where in FIG. 9 one shaft is formed as a rotatable cylinder and in FIG. 10 both shafts are formed as rotatable cylinders 37 and 38. With turnable cylinders like the ones shown, different distances for the two shafts of the warp frame are possible. In FIG. 11 it is shown in a schematic way, how directly after the warp thread station and before the holding-position a sizing-bath is introduced, that is used for the sizing of the warp threads which were layed into the warp frame within the warp thread station. In the holding position a dryer 40 can be seen, that is used for drying of the sized warp-threads.

Figure 12:
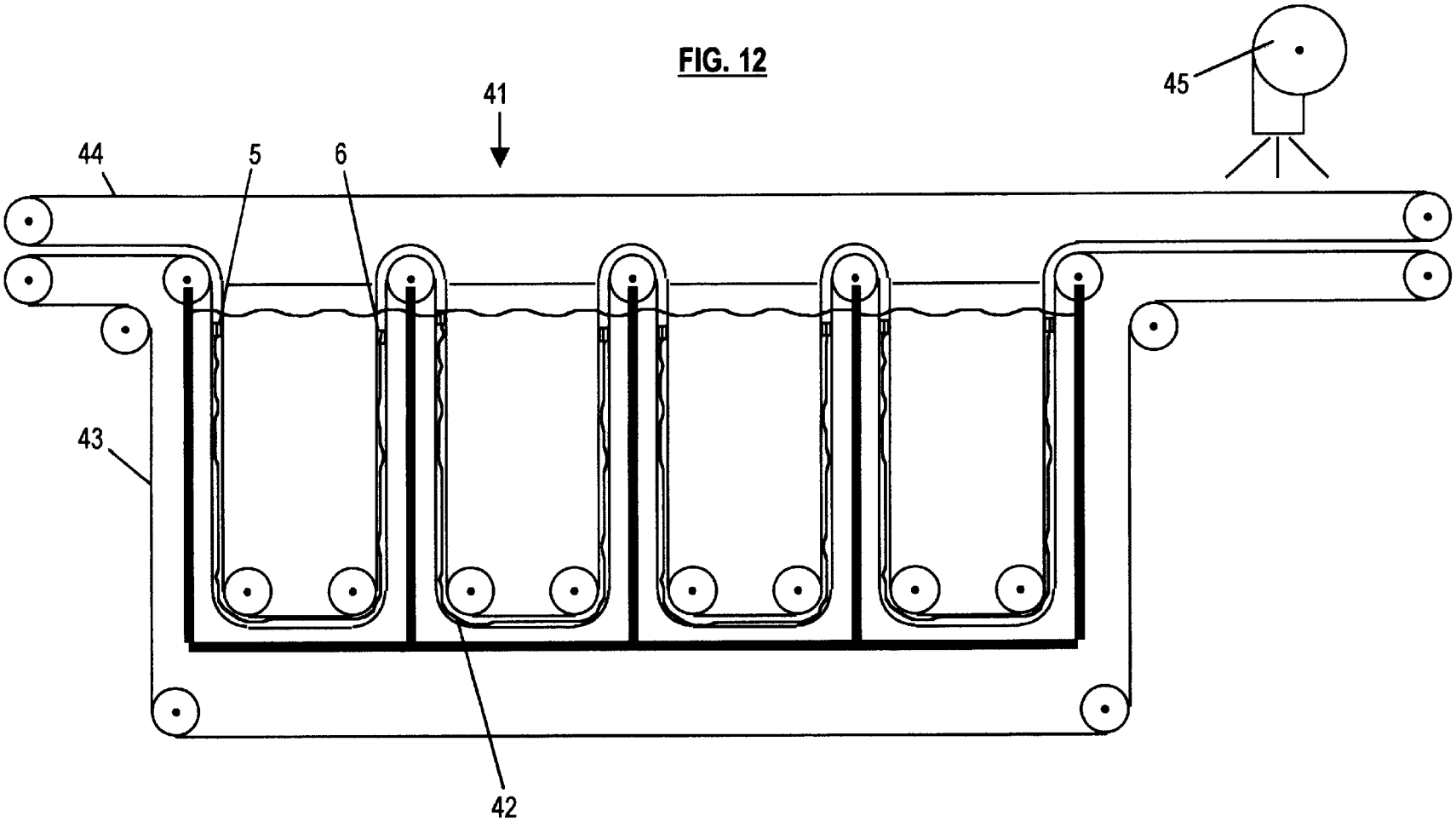

FIG. 12 shows a finishing station, that can be introduced between the weft-thread-station 2 and the take-out-station 3. In this finishing station 41, the completely woven fabric is guided over several guide rollers through a set of different baths, as they are known to be necessary for finishing processes. The transport of the woven fabric 42 is done by transport belts 43 and 44, that are running on top of each other and are guiding the woven fabric through the sequence of the different baths. The transport belts 43 and 44 are made of liquid-permeable material, as for example, a kind of net or a perforated rubber belt. The woven fabric 42 is guided through the finishing station 41 in individual pieces (i.e. warp-frames), where the beginning and the end are guided by the shafts 5 and 6 from which the distance holding bridges 7 and 8 were removed, so that the woven fabric can be transported over the different guide-rollers through all baths without a problem.

At the exit of the finishing station the dryer 45 is shown, that is drying the processed woven fabric.

Figure 13:
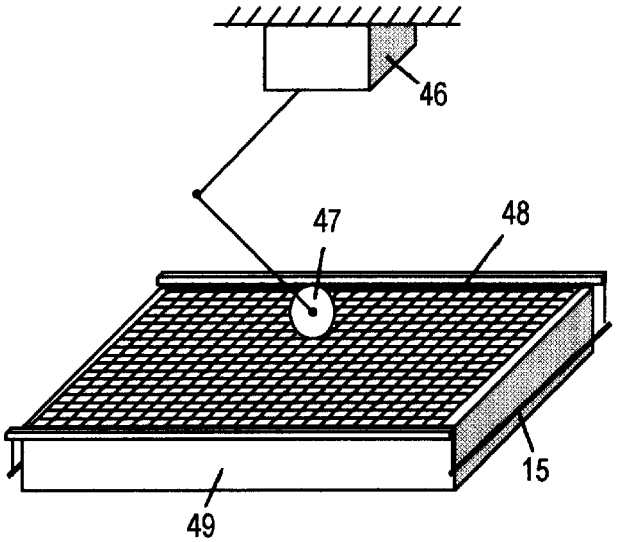
FIG. 13 is a perspective view of the process step of cutting.

FIG. 13 shows in a schematic way a cutting station, that can be introduced before or within the take-out station 3. With the rotating knife 47, that is moved by the controller 46 across the woven fabric which is still held by the warp-frame 15, the desired piece of fabric can be cut out according to a pattern-chart or electronic cutting data. For this, the warp frame 15 is put onto the cutting table 49, of which the surface holds against the woven fabric 48 from one side, so the knife 47 has a good counter point while cutting from the other side.

What is claimed is:

1. Method for manufacturing a woven fabric (42,48) having a limited length comprising the following steps:

laying a layer of warp threads (9) by means of laying mechanisms (10,11) on at least one warp frame (4,15) having a size which is determinative of the limited length of the fabric and holding said warp threads (9) on said warp frame in a warp thread station (1), moving said warp frame (4,15) to a weft insertion mechanism (12,13) having a shed forming device, laying weft threads (14) by means of said weft insertion mechanism (12,13) into said warp threads while operating said shed forming device in a weft thread station (2), transporting said warp frame (4,15) having a completed fabric (42,48) thereon to a fabric removal station (3), removing said completed fabric (42,48) from said warp frame, and transferring said warp frame (4,15) back to the warp thread station (1).

2. Method according to claim 1, including the step of sizing said layer of warp threads prior to moving said warp frame to said weft insertion mechanism.

3. Method according to claim 1, including the step of subjecting said woven fabric (41,48) to a finishing process after having been transferred to said removal station while still being maintained on said warp frame (4,15).

4. Method according to claim 1, including the step of cutting the woven fabric (42,48) while still being maintained on said warp frame (4,15).

5. Method of claim 1, including the steps of holding the warp threads (9) taut or slack in said warp frame.

6. Method of claim 1, including the step of laying said threads (9) while said warp frame is positioned in a horizontal mode.

7. Method of claim 1, including the step of laying said warp threads (9) while said warp frame is positioned in a vertical mode.

8. Method of claim 1, including the step of knotting the warp threads of two warp frames onto each other.

9. Device for manufacturing a woven fabric (42,48) having a limited length wherein said device operates according to the following steps:

laying a layer of warp threads (9) by means of laying mechanisms (10, 11) on at least one warp frame (4,15) having a size which is determinative of the limited length of the fabric and holding said warp threads (9) on said warp frame in a warp thread station (1), moving said warp frame (4,15) to a weft insertion mechanism (12, 13) having a shed forming device, laying weft threads (14) by means of said weft insertion mechanism (12, 13) into said warp threads while operation said shed forming device in a weft thread station (2), transporting said warp frame (4,15) having a completed fabric (42,48) thereon to a fabric removal station (3), removing said completed fabric (42,48) from said warp frame and transferring warp frame (4,15) back to the warp thread station (1), wherein said warp frame (4,15) consists of at least two shafts (5,6) that are facing each other and having means (31/32) thereon for holding said layer of warp threads.

10. Device according to claim 9, including two bridges (7,8) for holding said shafts (5,6) at a fixed distance.

11. Device according to claim 9, including means for moving said shafts (5,6) between a distance defining a limited length and a shorter distance.

12. Device according to claim 9, wherein at least one of said shafts is formed as a rotatable cylinder (37,38).

* * * * *